US005096604A

United States Patent [19]

Miller

[11] Patent Number: 5,096,604

[45] Date of Patent: Mar. 17, 1992

[54] IN SITU REPAIR OF FAILED MECHANICAL SEALS

[75] Inventor: Charles E. Miller, Tennessee Ridge, Tenn.

[73] Assignee: Tennessee Valley Authority, Muscle Shoals, Ala.

[21] Appl. No.: 556,140

[22] Filed: Jul. 23, 1990

Related U.S. Application Data

[62] Division of Ser. No. 303,379, Jan. 30, 1989.

[51] Int. Cl.[5] ..... C10M 107/50; C10M 111/02; C09K 3/10

[52] U.S. Cl. ..... 252/11; 252/32; 252/49; 252/49.3; 252/49.6; 252/56 R; 106/33

[58] Field of Search ..... 252/32, 49, 49.3, 49.6, 252/56 R, 11; 106/33

[56] References Cited

U.S. PATENT DOCUMENTS 2,584,413 2/1952 Baer et al. ..... 252/49.6
2,652,364 9/1953 Woods et al. ..... 252/49.6
2,911,369 11/1959 Zajac ..... 252/49.6
4,759,860 7/1988 Tanaka et al. ..... 252/56 R

*Primary Examiner*—Prince Willis, Jr.
*Assistant Examiner*—Jerry D. Johnson
*Attorney, Agent, or Firm*—Robert A. Petrusek

[57] ABSTRACT

The technique of the instant invention includes the preparation of a new mechanical seal life prolonger (SLP) by the compounding of a relatively few, inexpensive, and readily available materials. The instant technique is simply and easily placed into practice by, for example, applying relatively small amounts of such compound to the outside edges or peripheral portions of the relative movement interface between the seal faces of mechanical seals in association with fluid handling devices while such devices are in an operating mode. Depending on the degree of disruption of the sealing surfaces, a single application of such compound is sometimes sufficient to obtain the desired results or it may be necessary to subsequently apply such compound to the leaking seal at regular intervals subsequent to the first application thereof, until such time as it may be convenient to replace such seal faces.

11 Claims, No Drawings

IN SITU REPAIR OF FAILED MECHANICAL SEALS

The invention herein described may be manufactured and used by or for the Government for governmental purposes without the payment to me of any royalty therefor.

This is a division of application Ser. No. 303,379, filed Jan. 30, 1989.

INTRODUCTION

The present invention relates to a new, novel, and relatively simple and inexpensive, as well as highly successful method, means, compound, and system which has been discovered to be eminently suitable for the in situ repair or correction of the mating surfaces of mechanical seals of the type currently used in the linking together of drive means such as, for example, the rotating drive shaft of an electric or other type motor with fluid handling or moving devices such as, for example, pumps of the impeller type. The term "pump(s)" is used herein, for the convenience of the reader, to refer to and/or include the seal assembly which in one embodiment thereof comprises a two-component arrangement with one portion thereof attached, by any convenient means, to the pump casing and the other portion thereof attached, by any of a number of convenient means, to the rotating pump shaft, said rotating pump shaft normally being in operative association with drive means therefore. The instant invention involves the preparation of a new mechanical seal life prolonger (SLP) by the compounding of a relatively few, inexpensive, and readily available materials and requires only a minimal amount of relatively inexpensive equipment for the proper application thereof. It is simply and easily placed into practice by, for example, applying relatively small amounts of such compound to the outside or peripheral portions of the sealing surfaces of fluid handling pumps while such pumps are in active operation. The term SLP is used herein, for the convenience of the reader, to refer to and include the instant new compound, and/or the technique, and/or method of use or application thereof upon the seal assembly, whether such seal assembly is in static mode or, most preferably, in relative movement operating mode.

A principal feature of the instant invention is the fact that the practice thereof allows for the continued operation of such equipment for substantial periods of time after the seal is first observed to leak thereby allowing for such equipment, and perhaps more importantly equipment operatively associated therewith, to be operated for such time as may be necessary and convenient for a preplanned cessation of operation.

Depending on the degree of degradation of the sealing surfaces, a single application of such compound is sometimes sufficient to obtain the desired results. On the other hand, it may be necessary to subsequently apply the instant, new, and novel compound to the leaking seal at regular intervals, subsequent to the first application thereof, until such time as it may be convenient to replace the seal faces. It will be appreciated that this feature of the instant invention is of particular importance in the operation of any number or variety of industrial plants, including petroleum or nonpetroleum chemical processing and, as described in greater detail herein, fossil-fueled and nuclear-powered electric generating units, as well as equipment attendant therewith; when it is realized that the continued optimum operation of such units is of substantial importance to the health, safety, and security of literally millions of citizens and that an unplanned outage or reduction in operating efficiency thereof may otherwise be necessitated by the requirement of replacing a single leaking seal. That is not to say that every leaking seal in plants of this type will necessitate the slowing or closing down of an installation of this type; however, there indeed are units in certain critical areas which, even though provided with redundant or parallel operating apparatus, oftentimes present just such predicaments due to considerations for attendant equipment and/or health and safety measures. It will also be appreciated that this feature of the instant invention is of significant importance in the operation of any number of power plants utilized for the propulsion of vessels, including those of the marine type, and which may drive large naval ships of the type operated by the military.

BACKGROUND OF THE INVENTION

1. Field of the Invention

The present invention relates to methods and means for the in situ repair of mechanical seals of the type currently used in effecting an interface between two pieces of equipment between which there is relative movement, including a moving shaft and the housing through which it passes. Such a seal assembly, in one embodiment thereof, comprises a two-component arrangement with one portion thereof attached by any convenient means to a pump casing and the other portion thereof attached by any of a number of convenient means to the rotating pump shaft, said rotating pump shaft normally being in operative association with drive means therefore. One commercially available configuration of such a seal assembly may take the general form of two rings with the inside diameters and the outside diameters of each ring being approximately equal, one to the other, each of said rings having at least one flat side thereof, the width of said at least one flat side thereof being generally defined by said inside and outside diameters, said rings being concentric about a common axis and spaced longitudinally there along in juxtaposition with one another to effect a mating relationship between the at least one flat side, i.e., seal face, of each such ring. In many such type of assemblies, the use of resilient means, such as springs, are employed in a manner so as to urge or nudge said rings together. In operation, the surfaces of said rings, in juxtaposition with one another move relative to one another, i.e., one of said rings will rotate in unison with the pump shaft and the other is in stationary relationship along with the pump casing. After prolonged usage of such seal assemblies, the original closely mating surfaces thereof which provide the sealing means, i.e., the seal faces, are disrupted by the debris ingesting conditions normally presented by the fluid sealed thereby. Such disruptions may take the form of debris, such as suspended particulate matter, along with grease and/or grime carried in such fluid or on the surfaces such particulate matter, rust, or scale subsequently formed within the pumping loop, being physically lodged between said mating surfaces thereby effecting the wedging of same apart one from the other. Such disruptions may also take the form of minute, but significant indentations in the otherwise essentially optically flat seal face surfaces, which apparently result from the scratching or scoring action provided by the movement of particles of such debris over such surfaces. The net result of such wedging of such particles between the seal faces and/or the resulting scoring thereof results in subsequent leakage of fluid through the seal. The practice of the present invention repairs or corrects the deleterious effects of such disruptions by the use of the instant new mechanical SLP which is produced by the compounding of a relatively few, inexpensive, and readily available materials and requires only a minimal amount of relatively inexpensive equipment for the proper application thereof. The instant invention is simply and easily placed into practice by, for example, applying relatively small amounts of such compound to the outside or peripheral portions of the sealing surfaces, i.e., at the outermost juncture of the interface between said rings wherein they are juxtaposed with one another and move relative to one another. It has been found that a hypodermic needle can be used to send a fine stream of said SLP to said interface, or a misting device, such as an aerosol sprayer can be used to apply said SLP. It has also been discovered quite unexpectedly, that the instant, new, and novel SLP works completely satisfactorily and successfully even though it is applied to the juncture of said seal faces only at the outermost portion thereof, i.e., at the periphery, and even while such pumps are in active operation. The fact that the instant invention works at all seems to defy certain of the basic laws of physics when it is realized that oftentimes the moving seal face, of the two faces comprising such type of mechanical seals, is normally rotating at substantial speed and the resulting centrifugal forces that would be imparted to any material applied thereon would tend to sling same outward and away from the contact surfaces of the seal, rather than allowing such material, including the fluid comprising said SLP, to penetrate same. It should also be appreciated that the fluid which is contained by the seal is generally under considerable pressure and when a seal begins to leak such pressure will, of course, cause the fluid to exit the assembly at a rather rapid rate and thereby tend to carry away material applied to the outside thereof. I am not cognizant of a theory to readily explain this unexpected result and observation in and of the practice of my invention—perhaps the application of the SLP to the outside of the seal assembly so alters the contact angle, or other surface tension characteristics of the fluid leaking therefrom so as to allow for the penetration of the SLP either alone or in combination with some portion of fluid leaking therefrom, into and onto the juxtaposed seal faces to thereby effect the principal objectives of the instant invention. In any event, the application of said SLP to such seal assemblies has been observed, in extensive testing thereof, to either completely eliminate or to at least substantially reduce such leaking to a point wherein it is so minute or inconsequential so as not to present any danger to attendant equipment nor to be of a significant health or safety concern. It is believed that several mechanisms are at work as said SLP effects the desired and required results. In the first place, the SLP is able to penetrate the seal assembly, while same is in operating mode, so as to be placed in the proper location to repair or correct the unwanted and undesired leaking thereof. In the second place, the SLP effectively acts upon any debris caught or wedged between the faces of such assembly to cause same to be flushed away. In the third place, the SLP acts upon the surfaces of the seal faces in a manner analogous to a lapping compound to resurface or smooth such damaged faces.

2. Description of the Prior Art

The operation of a multitude of fluid chemical process and handling equipment wherein are located rotating parts and, in particular, wherein are located mechanical interfaces between such rotating parts and parts that are either stationary or which move relative to such rotating parts, has required the design and utilization of a variety of sealing means therefore. Many of such prior art arrangements are disclosed in the literature and involved numerous designs and variations of earlier designs which utilized packing arrangements. Although such arrangements did effect sealing, they were fraught with the inherent difficulty of not providing zero leakage around pump shafts, and the like, which oftentimes resulted in the causing of excessive wear of the pump shaft or sleeve.

Many years ago, as the evolution of seal designs progressed, the mechanical seal of the type herein described and referenced came into common usage. Although there are numerous arrangements and designs for such modern day mechanical seals, for the purposes of the following discussions and descriptions of the instant invention and how same is practiced, and in the interest of brevity and conciseness, these descriptions will be directed to a seal design of the general configuration, infra, it being understood that the instant invention is not necessarily limited thereto. Such seal design and assembly generally comprises the form of two rings, with the inside diameters of each ring being about equal, and the outside diameters of each ring being about equal. Each of said rings has at least a first flat side thereof, with the width of said at least first flat side being generally defined by said inside and outside ring diameters, i.e., the width of each ring approximates the length difference represented by said inside and outside diameters. The rings are arranged concentrically about a common axis, which is usually the same axis as the pump shaft, and are spaced together so as to effect a mating relationship between the at least one flat side of each such ring. Said at least first flat side of each ring, generally known as the seal face, is provided with an extremely flat surface, even approaching optically flat, so as to present to the equally flat surface of the oppositely facing ring a surface capable of joining therewith for forming a sliding sealing surface interface. To ensure that the two surfaces slide past one another with consummate ease, i.e., the coefficient of sliding friction is as low as possible, the seal face materials of construction, or at least of facing, may be different from one another. For instance, the stationary face material may be silicon carbide, tungsten carbide, or ceramic; whereas, the rotary face material may be carbon, silicon carbide, or ceramic. The side of each ring disposed opposite to each respective at least first flat side, as well as in some designs at least a portion of the peripheral surface thereof, is generally arranged in sealed relationship with the respective housing attendant each ring. In many such type of assemblies, the use of resilient means such as springs are employed in a manner so as to urge or nudge the seal faces of said rings together.

In operation, the surfaces of said rings, in juxtaposition with one another, i.e., the seal faces, move relative to one another. For instance, one of said rings will rotate in unison with the pump shaft and the other is in stationary relationship with the pump casing. It will be appreciated that this design of seal assemblies is far superior to that of earlier designs which utilized a variety of packing arrangements. It will also be appreciated by those skilled in this art that, superior as this later design may be over earlier arrangements, after prolonged usage of such seal assemblies the original closely mating surfaces thereof, which provide the sealing means, are disrupted by the debris ingesting conditions normally presented by the fluid sealed thereby. Such disruptions may take the form of debris such as suspended particulate matter carried in such fluid, or rust or scale subsequently formed within the pumping loop, being physically lodged between said mating surfaces, thereby effecting the wedging of same apart, one from the other. Such disruptions may also take the form of minute, but significant, indentations in the otherwise essentially optically flat seal face surfaces which apparently result from the scratching or scoring action provided by the movement of particles of such debris over such surfaces.

As may well be appreciated by those skilled in this art, undoubtedly there have been numerous prior art investigators who have sought to discover any method and/or means for attempting the repairing of leaking mechanical seals of the type just described, supra, with particular emphasis on the effecting of such leaks while such seal assemblies are in operation and the equipment to which they are operatively associated is online. In searching the literature, both formal and that comprising vendors catalogs, I have been unable to find any reference to mechanisms, methods, or means for effecting such repairs, short of taking the pump unit offline and disassembling same to remove the leaking mechanical seal and replacing same with a new one. Likewise, a search of such references has not revealed the existence of, nor even an inference to any compound, mixture, or other product represented by any reputable manufacturer which will prolong the life of such a leaking seal by stopping same from leaking for an extended period of time so as to allow same to remain online until a more opportune time to effect such disassembly presents itself. In the instance of such a seal leaking in any number of critical areas of an electric generating unit, such as a fossil-fueled or nuclear-powered steam plant, such a more opportune time would be when the load on the system in which such unit is networked is not critical or when there exists a preplanned outage for effecting regularly scheduled maintenance and repair.

In German Offen. DE 3,447,346 Al, Fahl, Jun. 26, 1986, there is taught new high-viscosity lubricants for use on water line fittings such as valves, pumps, etc., which appear to yield service lives perhaps some four times that of other lubricants tested. These teachings disclose that such new lubricants comprise basically the following four categories (1) a thickener (optional)—can include metal soaps, polyurea, polytetrafluorethylene, montmorillonite and mixtures thereof (20 weight percent); (2) a lubricant (base component)—can include a naturally occurring (paraffinic white oil), or synthetic high-viscosity lubricating (polymeric) oil; (3) a complexing agent to remove the $Ca^{+2}$ and/or the $Fe_2O_3$—can include polyphosphoric acid, amino acid, derivatives of acetic acid polyamine (i.e., ethylenediamenetetraacetic acid, nitrilotriacteic acid, etc.), and mixtures thereof (0.3–3, preferably 0.5–1.5 weight percent); and (4) a water proofing agent—can include tall oil resins, an alkyd resin, and mixtures thereof. This water-proofing material may be a necessary component when (2) supra, is not a silicone base material (0–12, preferably 2–10 weight percent). As will be seen, infra, and appreciated after thoroughly reading the full disclosure herein, the compound of the instant invention, including the instant new SLP, although utilizing a soap and a dilute source of acetic acid, cannot be of high-viscosity. Therefore, the use of either a high-viscosity silicone oil or grease, as taught in Fahl, supra, is contrary to the instant teachings. Furthermore, his high-viscosity silicone material comprises some 80 percent of his lubricant, whereas the relatively low-viscosity silicone oil utilized in the preparation of the instant SLP, most preferably comprises only about 20 percent thereof. Also, Fahl uses his soap as a thickener and in amounts of about 20 percent, on a weight basis, as opposed to the instant invention which uses about 40 percent on a volume basis. Likewise, he uses less than about 3 percent—preferably 1.5 percent of a complexing agent as opposed to the instant invention which uses some 10 percent thereof. In addition, it will be appreciated that Fahl teaches the use of, as his water proofing agent, quite different materials, i.e., tall oil or alkyd resins as opposed to the instant invention which uses lemon and/or orange peel oil. It will be further appreciated that Fahl does not teach the use of a penetrant, such as the instant inventions use of Kroil ®. Finally, it will be appreciated that although the lubricant taught by Fahl obviously will prolong the life of certain water line fittings, there is no teaching, or even inference, that same can be utilized in the system or in the manner taught in the instant invention.

SUMMARY OF THE INVENTION

The instant invention relates to a vastly improved technique, including the discovery of a new combination of materials eminently useful for the in situ long term temporary repair of leaking mechanical seals including those of the type having a stationary face and a rotary face, for example, seals known in the art as cartridge single seals. The technique or method of the instant invention involves the preparation of the new SLP by combining a relatively few, inexpensive, and readily available materials and applying relatively small amounts of the resulting mixture to the outside of the interface between said stationary face and said rotary face while such devices are operating in the environments for which they were designed. Depending on the degree of disruption of the sealing surfaces, a single application of such compound is sometimes sufficient to obtain the desired results. However, in most instances it is necessary to subsequently apply similar quantities of the SLP compound to the leaking seal at regular intervals until such time as it may be convenient to replace the seal faces. Regular intervals between applications of the SLP can vary from one to a few days to as much as eight to ten days or even fourteen days, with an interval of about one week usually being the most convenient and productive, albeit, some seals have gone for as long as three or four months between applications of said SLP. The amount of SLP that is required to be added to the seal is quite small, i.e., usually two or three cubic centimeters (cc) is sufficient. Relatively inexpensive syringes, such as the type sold or dispensed for use with insulin shots, or the like, are quite useful and sufficient as means for application of the SLP.

The practice of the new, novel, and unexpected discovery of the instant invention enables one skilled in the art to compound a new material that can be sprayed, or otherwise applied to the outside of a mechanical seal, penetrate the seal assembly, and stop such seal from leaking—without the need or requirement to disassemble and repair such seal. The economic implications and ramifications of the value of the present invention are believed to be immediately obvious to all skilled in this art. For instance, almost any mechanical seal will, in time, start to leak, due mostly to wear or disruption of the sealing surfaces. In the operation of a steam plant used for the generation of electricity, the development of a leaking seal oftentimes gives rise to the necessity of a judgment call as whether to pull the pump out of service and thereby effect the efficiency of the power plant operation or to continue operation of the pump unit until a more opportune time, such as when the load on the network fed by such power plant is not critical, or until the occurrence of a planned plant outage. In the later alternative, if the seal is allowed to leak it will only get worse, water from the seal leak will be slung by the shaft rotation or sprayed by the back pressure from within the pump thereby causing the following problems:

(a) water being slung or sprayed onto or into the pump or strainer bearings will displace the lubrication of the bearing thus resulting in unscheduled and premature failure of this equipment;

(b) water that is slung or sprayed into the electric motor can cause damage to the motor windings and bearings thereby resulting in an unscheduled and premature failure of the motor; and (c) water that is slung or sprayed into or onto the electric motor can cause safety hazards from electric shocks and/or slippery floors.

In instances of election of the former alternative, supra, i.e., a decision is made to pull the pump, depending upon the pump unit involved the resulting effect on the steam generating unit production efficiency could represent a total cost to the utility well in excess of one million dollars. For instance, in the operation of a plant having one or more generating units rated at a load capacity of 1300 megawatts each, if the pump unit that is leaking and which requires immediate shutdown happens to be a boiler feed booster pump strainer and no redundancy exists in the system for backup, the resulting two-day outage, which would be necessitated for rebuild thereof, translates to a loss of about 600 megawatt days or, in terms familiar to residential customers, almost 15 million kilowatt hours. In the instance of necessitating an outage of one boiler feed pump, the loss of generating capacity is just about double that lost by the outage of one boiler feed booster pump strainer, supra. These figures are based on lost generating capacity and do not reflect the added costs of parts or labor, nor do they reflect the added costs represented by having to purchase power from other utilities at times of peak load or utilize other, more expensive to operate, sources of steam generation for meeting such peak load requirements. Accordingly, it should be readily apparent to even those not well acquainted with this art that the advantages gained from the practice of the instant invention are indeed substantial and significant.

OBJECTS OF THE INVENTION

It is therefore the principal object of the present invention to devise techniques and systems, as well as develop new methods and/or means for easily, quickly, and effectively correcting, repairing, or otherwise alleviating, for substantial periods of time, the deleterious effects resulting from mechanical seal face failures, while eliminating or at least substantially minimizing, the disruptions normally associated with a cessation of attendant equipment operation during the period of time required for the repair or correction thereof.

A further object of the present invention is to devise such techniques or systems and to develop such new methods and/or means for easily, quickly, and effectively correcting, repairing, or otherwise alleviating such deleterious effects, resulting from the failures of mechanical seal faces, for periods of time of sufficient length so as to effect continued operation of such mechanical seals until the occurrence of a preplanned event, while substantially eliminating the disruptions normally associated with a cessation of operation of attendant equipment during such repair or correction period.

Another object of the present invention is to devise such techniques and to develop such new systems or methods and, most importantly, means for easily, quickly, and effectively correcting, repairing, or otherwise alleviating such deleterious effects, resulting from the failures of mechanical seal faces, for periods of time of sufficient length so as to effect continued operation of such mechanical seals until the occurrence of a preplanned event, while substantially eliminating the disruptions normally associated with a cessation of operation of attendant equipment during such repair or correction period and wherein said means comprises a compound, mixture, or combination of materials, which when properly juxtaposed said seal faces will effect such desired correction or repair thereof and; further, wherein such preplanned event comprises an outage staged for regularly scheduled maintenance and/or repair of equipment operatively associated, either directly, or indirectly with said seals.

A still further object of the present invention is to devise such techniques and to develop such new methods and, most importantly, means for easily, quickly, and effectively correcting, repairing, or otherwise alleviating such deleterious effects, resulting from the failures of mechanical seal faces, for periods of time of sufficient length so as to effect continued operation of such mechanical seals until the occurrence of a preplanned event, while substantially eliminating the disruptions normally associated with a cessation of operation of attendant equipment during such repair or correction period and wherein said means comprises a combination of materials, which when properly applied to said seal faces will effect such desired correction or repair thereof by effecting efficient and quick removal of debris ingested between such seal faces and/or by quickly and efficiently substantially eliminating indentations, such as scratches, from the mating portions of such seal faces and further wherein such preplanned event comprises an outage staged for regularly scheduled maintenance and/or repair of equipment operatively associated, either directly, or indirectly with said seals.

Still further and more general objects and advantages of the present invention will appear from the more detailed description set forth below, it being understood, however, that this more detailed description is given by way of illustration and explanation only, and not necessarily by way of limitation since various changes therein may be made by those skilled in the art without departing from the true spirit and scope of the present invention.

DESCRIPTION OF THE PREFERRED EMBODIMENTS

In accordance with the teachings of the instant invention I have now discovered a new class or combination of materials which have proven to be eminently suitable for the in situ correction and/or repair of the seal faces of mechanical seals of the type currently used in any number of chemical processing operations including, for example, the transfer of cooling water in the operation of steam generating plants utilized for the generation of electricity. The present invention also teaches a technique and provides for such new mixtures of materials, which when compounded according to the dictates of newly discovered parameters and utilized by procedures outlined herein, are eminently useful for such in situ repair or correcting disruption of the mating or sealing surfaces of such mechanical seals. The instant invention involves the preparation of the SLP by the compounding of a relatively few, inexpensive, and off-the-shelf materials and easily placed into practice by applying small amounts of same to the peripheral portions of the relative movement interface which necessarily exists between the stationary face and the rotary face of such mechanical seals when such pumps are in operation. It is, of course, understood that the instant invention can be put into practice on seal assemblies that for one reason or another, are idle or stationary. For instance, a pump having a seal assembly which was leaking to such a degree that is immediate shutdown was required may be treated with said SLP and thereafter started back online. The flushing and lapping action of the SLP will be effected subsequent to such application and at or after such time as said seal assembly is back in operative mode, i.e., the pump is online and running. Practice of the instant invention allows for the continued operation of the equipment served by the mechanical seal for substantial periods of time after the seal is first observed to leak and after either a single or a succession of applications of the SLP thereto, thereby allowing for such equipment, and perhaps more importantly, equipment operatively associated therewith to be operated for subsequent and extended periods of time as may be necessary and convenient until the occurrence of a preplanned event such as, for example, a regularly scheduled plant outage.

The makeup of my new and novel mixture which constitutes the SLP comprises basically at least one material selected from each of the following five generalized categories:

(1) a cleaner;
(2) a complexing agent;
(3) a lubricant;
(4) a penetrant; and
(5) a water repellent.

A number and variety of off-the-shelf materials were experimented with, some of which have more or less proven to be effective in each of the five categories, supra. In addition, it was found that although the relative amounts of materials which can be used in each of said categories can be varied within certain limits, there definitely are preferred and most preferred amounts, or relative proportions of each which yield the desired results, attain the numerous advantages, and meet the intended objectives of the instant invention.

It is to be understood that the percentage figures given here and elsewhere in the descriptions of the instant invention are on a volume basis, unless otherwise noted. The component comprising a cleaner, (1) supra, can be selected from a variety of liquid soaps, detergents, and other metallic or nonmetallic based cleaning agents, as well as materials which are precursors therefore, and which are widely marketed for light or heavy duty industrial usage or for use as residential cleaners. The intended purpose of such cleaner is to remove the ingested debris that is found wedged between the two seal faces. The preferred industrial liquid detergent is oftentimes marketed under the name of Tornado ® and the preferred residential-type liquid detergents are liquid Ivory ® and Dawn ®. The liquid detergent usually accounts for about 40 percent of the total mixture.

NOTE: Any references made herein to materials and/or apparatus which are identified by means of trademarks, trade names, etc., are included solely for the convenience of the reader and are not intended as, or to be construed, an endorsement of said materials and/or apparatus.

As used herein the term cleaner includes and means soaps, detergents, and other metallic or nonmetallic based cleaning agents and substances that are precursors of such soaps, detergents, or other metallic or nonmetallic based cleaning agents. A dissertation on the general methods of preparation for liquid soaps may be found in the Chemical Formulary edited by H. Bennett, Volume I, by the Chemical Publishing Company Inc., New York, 1933, bridging about pages 79–84. For purposes of teaching, disclosing, and claiming the instant invention, the teachings, and disclosures of said Chemical Formulary, supra, are herewith and hereby incorporated herein by reference thereto. As may be seen from this reference, many of the earlier liquid soaps were prepared from coconut oil and/or soy bean oil which had been saponified with potassium hydroxide and about one part of the soap obtained therefrom dissolved in usually about three parts of water. Presumably, lesser amounts of water could be used and, as indicated therein, oftentimes greater amounts are used for the lower priced products. Depending on the degree of neutrality required any excess alkali in such liquid soap bases oftentimes was corrected by the addition of relatively small amounts of oleic acid thereto. Numerous liquid soaps such as those made with coconut oil or a combination of palm/kernel oil and vegetable oil are diluted with water in order to extend same and lower the cost of production. In such instances wherein there are high percentages of water present ethyl or grain alcohol, glycerol, or sugar are added to lower the freezing point and also to reduce the subsequent clouding of the finished product, which clouding causes a degree of sales resistance. In many such instances pine oil is added to such compositions to effectively increase the cleaning action thereof and also to impart a desirable pine fragrance to the liquid soap. Also, many liquid soaps are found to contain small percentages of trisodium phosphate (TSP) particularly those of the pine oil type just supra. Presumably, the TSP acts as a precursor of and in such soap. Still other liquid cleaners have incorporated therein ethylene glycol, i.e., antifreeze, as an active cleaning agent alone or in combination with relatively small amounts of alcohol; see for instance, the formula for a popular window cleaning agent marketed under the trade name Windex ®. Other liquid cleaning agents, which are not by definition, soaps, are oftentimes referred to as liquid detergents. The chemical makeup, as well as the relative concentrations of such materials is usually considered as proprietary information by their manufacturers. Suffice it to say, that for the purposes of the instant invention, these materials are suitable for use if they dissolve the grease or dirt in an expeditious manner, they are pourable at normal operating temperatures, or at least can be diluted to so be, they are nonreactive with the innards of the pump and attendant equipment, as well as the various o rings and/or glands which may be operatively associated therewith, and the availability and economic attributes are reasonable.

The component comprising a complexing agent, (2) supra, can be selected from materials which will remove the scale which has been observed to be built up on a number of the ceramic surfaces on many seal faces after they have been removed from sustained service operation. Such scale is normally comprised of materials including $Ca^{+2}$ cations, and it was found that a dilute source of acetic acid, such as household vinegar, is a suitable source for this constituent and usually accounts for about 10 percent of the total mixture. Such household vinegar, of course, is usually the bacterial fermentation product of apple cider, wine, etc. It contains generally from about 4 to about 8 percent acetic acid. Although not as readily available as vinegar as a source for such acetic acid, glacial acetic acid, after proper dilution with water, may also be used as a source for such acetic acid. As will be evident from the disclosure, infra, it has also been determined that phosphoric acid may be used in place of or in partial substitution for such acetic acid as the component comprising said complexing agent. Phosphoric acids, of course, are marketed in any number and variety of concentrations as, for example, 85 percent $H_3PO_4$ vis-à-vis about 61 percent $P_2O_5$ and 105 percent $H_3PO_4$ vis-à-vis about 76 percent $P_2O_5$. Various concentrations of phosphoric acids have proven to be useful as a complexing agent. It will also be appreciated that when household vinegar is used to supply the complexing agent instead of utilizing 85 percent $H_3PO_4$ an equal volume percent of these two materials will contribute differing resulting complexing characteristics. As expected and shown in the examples, infra, an equal volume of 85 percent $H_3PO_4$ appears to be more effective than an equal volume of vinegar reduced with water to about 5 percent acidity. Accordingly, as used herein a "complexing agent" is a material which is used in an amount effective in the SLP to dislodge or remove scale and/or rust deposits and includes acetic acid, phosphoric acid, as well as mixtures thereof.

The component comprising a lubricant, (3) supra, is selected from any number of good grades of silicone oil, adjusted to rather low viscosity, and usually accounts for about 20 percent of the total mixture. The intended purpose of such lubricant is to effectively adjust the viscosity of the SLP in order to prevent further formation of indentations, such as scratches, which can occur when the particles of ingested debris are flushed across the seal faces by the action of the cleaner, supra, or by the action on such surfaces of the particles of yet undissolved scale resulting from the at least partially dissolving and dislodging of same by the action of the complexing agent, supra. As used herein the component comprising the "lubricant" is a material characterized by its ability to impart lubricating properties to the SLP and although any number of several types of natural petroleum derivatives or synthetic substitutions therefore may be utilized; it is oftentimes an overriding consideration in the selection thereof that there be no damage or degradation of the synthetic rubber o rings normally associated with the seal assembly. Accordingly, the most viable material for use as such a "lubricant" is comprised essentially of silicone oil, which silicone oil is provided in a viscosity ranging from about 10 to about 60 saybolt universal seconds (SUS) at 210° F. and preferably at about 30 SUS.

The component comprising a penetrant, (4) supra, is selected from any number of industrial grades of penetrating oils. The intended purpose of such penetrant is to more effectively provide for the carrying of the SLP into the area comprising the relative movement interface between the stationary face and the rotary face of such operating mechanical seals. The preferred penetrant of the instant invention is oftentimes marketed under the name of Kroil® and usually accounts for about 20 percent of the total mixture. Such penetrating oils, if comprised of petroleum distillates, are usually cut from the somewhat more volatile components than say kerosene. When subjected to distillation in accordance with the Standard Method of Test for distillation of gasoline, etc. (ASTM D86), they oftentimes fall within the generic definition for naphtha. Of course, in the makeup of such penetrating oils certain other materials such as alcohols may be combined with such naphthenic distillate and the resulting product mixed with high volatile carriers, which carriers may comprise anywhere from about 20 to about 80 percent of the mixture. Accordingly, as used herein the component comprising the "penetrant" is a material having as the substantial active ingredient therein a petroleum distillate including a naphthenic component thereof, which distillate has normally been chemically neutralized to a pH ranging from about 6 to about 8 and said distillate usually being in combination with substantially lesser amounts of hydroxyl-containing organic compounds and said distillate further being in admixture with organic liquid carriers characterized by their having high evaporation rates.

The component comprising a water repellent, (5) supra, is a citrus oil. Although it may be a citrus seed oil, in the preferred embodiments of the instant invention, it comprises a citrus peel oil which is generally known in the art as an edible oil expressed from the peel or rind of grapefruit, lemon, lime, orange, and tangerine. From the standpoint of ease of availability, it will be appreciated that from these citrus oils generally the lemon peel and the orange peel oils are the most accessible. Such lemon peel or orange peel oils are produced by grinding and/or pressing the peels of lemons or oranges or by solvent extracting the values therefrom. They have specialty marketing utility as, for instance, deodorizers or perfuming agents and furniture finishing. Such lemon peel or orange peel oils usually account for about 10 percent of the total mixture. The intended purposes of such water repellent are several-fold, to wit, (a) ensure homogeneity of the SLP; (b) act as an antifoaming agent, particularly in regard to the cleaner component thereof; (c) act as water repellent means; and (d) provide for a coating agent and/or lapping compound for ensuring repair of indentations, such as scratches which have been formed on the respective seal faces. Accordingly, as used herein the component comprising a "water repellent" is a material which acts to impart hydrophobic characteristics to the SLP as well as a substantial degree of homogeneity therein and in addition to acting as an antifoaming agent provides that degree of abrasive quality to the SLP to impart thereto the characteristics of a lapping compound wherein said materials consist essentially of citrus seed oils and more preferably citrus peel oils and still more preferably lemon peel oil and/or orange peel oil. As to said abrasive quality, supra, it has been postulated that certain interactions of the complexing agent at or near the seal faces, together with the action provided by said water repellent, substantially contribute thereto.

EXAMPLES

In order that those skilled in the art may better understand how the present invention can be practiced, the following examples are given by way of illustration only and not necessarily by way of limitation, since numerous variations thereof will occur to and will undoubtedly be made by those so skilled in this art without substantially departing from the true and intended scope as well as the spirit of the invention herein taught and disclosed.

In the pursuit of further information gathered for the purpose of more clearly defining the parameters affecting the practice of the instant invention the investigations herein were made to at least determine the necessity and relative proportions of the several components comprising the new and novel SLP, and the amounts as well as the repetition of application, thereof which are necessary for meeting and obtaining the objectives stated supra.

EXAMPLE I

In the earliest work on the present invention, several pumps in the subbasement of a large fossil-fueled steam generating plant had been pulled offline and disassembled for purposes of replacing the leaking mechanical seals thereof. It was observed that the seal surfaces, i.e., the seal faces, were dirty and gritty and that several of them were damaged, i.e., there were scratches on such seal face surfaces. It was noted that leaking of numerous mechanical seals on pumps used for moving hot water (such as an industrial grade steam cleaner) oftentimes could be stopped, or at least temporarily fixed, by pumping therethrough some of the cleaning compound of component (1), supra. Such seal leaks were stopped for rather extended periods of time, or at least substantially eliminated, without having to remove these pumps, disassemble the seal mechanisms, and replace the seal faces. Accordingly, a sample of such cleaning compound was utilized in various manners and with various means to attempt effecting a correction or repair of the leaking seals associated with numerous and different pumps in said steam plant. Said cleaning compound was determined to be a sodium/sulfur base soap which puts it in the category of being a metallic soap. In order for this to work, a way would have to be found to ingest the cleaning compound, or the like, from the outside into the interface existing between the rotary seal face and the stationary seal face which would be just opposite to the direction of ingestion of the debris which had found its way from the plant water inside the seal and onto such seal faces, thereby causing disruptions of the mechanical seals and/or causing the formation of the indentations or scratches observed on such damaged sealing surfaces. As may well be appreciated, in these earliest attempts to find a solution for fixing, correcting, and/or repairing of such leaking seals, while same were still assembled and running, the spraying or dribbling of such cleaning compound into or onto the areas of such interface caused the cleaning compound simply to be slung off of the seal assembly and/or the rotating pump shaft. There was no ingestion or penetration of same into the interface between the seal faces.

EXAMPLE II

In the series of tests comprising this example, the cleaning solution was tested as in Example I, supra; however, in these tests several amendments were made to such cleaning compound for the purpose of attempting to so modify its clinging and penetration characteristics such that the stated objectives of the instant invention could be attained. In so doing, it was found that the use of aqueous media mixed therewith had little or no beneficial effect. The cleaning compound and aqueous media combination was tested with a good, industrial grade of penetrant, such as the material Kroil®, mentioned above. Although the manufacturers of such penetrants do not divulge their makeup, they claim same to be a combination of solvents and oils. The material safety data sheet lists Kroil® in the petroleum lubricant chemical family and indicates a volume percent of ingredients as follows: forty percent chemically neutralized naphthenic distillate, less than three percent sec. butyl alcohol and less than three percent diacetone alcohol. The volatiles by volume are listed at 60 percent. The results of this experiment indicated that, indeed, there was some degree of penetration of the seal assembly by this combination of materials which appeared to "ride" the seal much better than the other materials tried so far. After this combination penetrated the seal assembly, it was observed to still foam and spill off same, but it was not foaming as much or being slung off the pump drive shaft to the same degree as was the material used in Example I, supra, nor the material sans the penetrant, just supra.

EXAMPLE III

In the series of tests comprising this example, further tests were made utilizing the cleaning solution that was experimented with in Example II, supra, and several more amendments were made to the cleaning compound for purposes of attempting to so modify its clinging and penetration characteristics. In these further investigations the aqueous media, i.e., distilled water, was dropped and lemon or orange peel oil was added to the modified cleaning solution. This decision was based on previous observations that such lemon or orange peel oil displayed a definite tendency to cause a substantial degree of homogeneity among it and the other constituents of certain compounds. In the conduct of these tests it was observed that the use of such lemon oil or orange peel oil, or both, to a marked degree, changed the otherwise attendant foaming of the further modified cleaning compound, said foaming due principally to the soap constituent therein. The resulting mixture of soap, penetrant, and lemon peel oil or orange peel oil, or both, worked much better than the material combinations comprising the cleaning solutions used in Examples I and II, supra.

EXAMPLE IV

In the series of tests comprising this example, the cleaning solution applied to several assemblies in the conduct of Example III, supra, was still further modified because it was observed that on some of the ceramic seal surfaces there was evidence of scale build-up adhering thereto. Accordingly, certain portions of vinegar were added to such cleaning compound to act as a source of acetic acid for effecting the at least partial dissolving of such built-up scale deposits and the removal of same from the seal faces. It is believed that the acetic acid acts in the manner of a complexing agent to thereby dissolve and dislodge the principal constituents of such scale, to wit, principally the calcium carbonates. In addition, as has been observed in tests, vinegar, has also proved somewhat effective in effecting removal of rust. Therefore, it is believed that the use of acetic acid as a complexing agent is effective in dissolving or complexing said calcium carbonates as well as iron oxides which might also be present. In addition, in order to prevent any further scratching of the seal faces by the action of the resulting dislodged or broken up scale particles as same are flushed through the relative movement seal face interface, a lubricant was added thereto to adjust the viscosity thereof to the optimum degree and to ensure that the effective coefficient of sliding friction, between such particles of dislodged scale and the surfaces of the seal faces, is minimized. Although several types of oil such as, for example, Sto-1® oil may accomplish the desired results, a good grade of lightweight silicone oil should be used to ensure that there is no damage to the synthetic rubber o rings operatively associated in and with the seal assembly. The silicone oil that has been utilized in the development and practice of the instant invention has a viscosity rating of 30 SUS at 210° F., about equivalent to 5-weight motor oil, and appears to have been thinned by the manufacturer with heptane.

EXAMPLE V

In the series of tests comprising this example, a great number of pumps were treated in the steam plant which were observed to be leaking and which would be, or had been "tagged out" for disassembly and seal repair. In many instances, the use of the SLP in the proportions listed in the invention parameters, infra, and characterized therein as the most preferred, was utilized since this is the very best formulation that was found. It should be further noted, however, that the compositions utilized in this example as well as Example VI and VII, infra, are further and more specifically characterized in that the soap utilized therein as the cleaner constituent was a sodium/sulfur base metallic soap and that the constituent comprising the complexing agent was acetic acid rather than phosphoric acid or a mixture of acetic and phosphoric acids and; finally, that the constituent comprising the water repellent was sometimes a lemon oil and sometimes an orange peel oil, albeit, indications from data obtained in other tests indicate that mixtures thereof work equally well as either one alone. It works substantially better than the formulations listed for the operating limits and the preferred limits. However, it is to be appreciated that the other formulations therein listed and which vary from this most preferred limit, or optimum mixture work well and, perhaps in some yet undefined set of conditions work as well or better than that so characterized as being the most preferred. Accordingly, with this proviso in mind, referenced below are some of the types of pumps with attendant leaking mechanical seals, which have been successfully treated to date, it being further understood, of course, that pumps with leaking mechanical seal assemblies that suffer from broken or cracked seal faces will not be corrected or repaired by practice of the instant new method, system, or means.

To date, the new and novel SLP has been used to stop leaking seals of the general type herein described in no less than 20 different pump and/or strainer units. The majority of these units fall in the following five categories:

(1) heater drain pumps;
(2) fly ash sluice pumps;
(3) bottom ash sluice pumps;
(4) L.A.D.I. supply pumps (Los Angeles Demineralizing System); and
(5) boiler feed booster pump strainers.

The instant, new, and novel SLP has also been found to be useful as a means for testing the integrity of certain seals. For instance, on a hot well sampling pump, used in conjunction with the steam plant laboratory, it was suspected that there existed an air leak on the suction side of said pump. The placement of a small portion of my SLP, usually about 3 cc's and normally not more than about 5 or 10 cc's being sufficient, on the seal at the pump shaft eliminated the "sucking" of air for a few minutes, thereby proving that the seals were indeed bad.

In still another embodiment for utilization of the instant invention, portions of the instant SLP have been successfully utilized to stop leaks at bonnet joints on five different heater drain pumps. In these instances, the leaks at such bonnet joints stopped completely dry within minutes after they were each sprayed with several cubic centimeters of such SLP and only such a single application thereof was found to be necessary to keep them dry over a period of several months.

EXAMPLE VI

In the series of tests comprising this example, heater drain pump 16A was treated over a period of approximately two months. During this period, the mechanical seal thereof was treated only once with some 3 to 5 cc's of the instant SLP during the initial portion of this period. This treatment was sufficient to stop the leak for almost a full month, after which the seal once more began to leak. After commencement of such leaking, it was found that subsequent treatment thereof was somewhat more demanding, i.e., it required much more frequent treatments to keep it from leaking. Accordingly, daily observations were made of its condition during the second half of the treatment period and it was sprayed almost each time coincident with each such observation. This heater drain pump was the toughest case encountered in all of the units tested, in that most of the other seals responded to repetitive treatments made each sixth, seventh, or eighth day with about 3 cc's of such SLP and were kept online for periods of time extending upwards of four to six months, i.e., until a planned plant outage.

EXAMPLE VII

In the series of tests comprising this example, the heater drain pump 16A which was treated for approximately a two-month period as described in Example VI, supra, was subjected to further testing over an additional period in excess of five months, i.e., a period similar to that for treatment of other seals as noted at the end of the previous example. The treatment procedure was essentially that as in Example VI, above; however, the period of inspection and application of the SLP was much less frequent than reported for the second half of the treatment period in Example VI, supra. For instance, during this testing period the leaking seal on heater drain pump 16A was treated on the first and third day of the period, treated a third time approximately one month later whereupon it did not require further treatment for approximately three months. At the end of said three-month period it was treated three times within a one-week period whereupon it was observed to apparently "settle down" and not leak throughout the remaining period comprising this test.

EXAMPLE VIII

In the series of tests comprising the previous three examples, i.e., Examples V–VII, the formulation was constituted as noted in Example V, supra. In the test comprising this example, the cleaner constituent was changed from a metallic-based cleaner, i.e., Tornado® to a cleaner such as Dawn® or liquid Ivory® which by some classification schemes, is considered as a nonmetal-based liquid detergent. Specifically the nonmetal-based cleaner used in this example was marketed under the trade name liquid Ivory®. Although the basic formula for the somewhat standardized formulation generally comprised about one part of both water repellent and complexing agent, about two parts of penetrant and lubricant, and about four parts of cleaner, the particular proportions of materials used in this test contained slightly more lemon oil as the water repellent, i.e., 1.4 parts, it being understood, of course, that these proportions are on a volume basis. It was found that by increasing the amount of water repellent by about 40 percent substantially eliminated the foaming action previously noted when the SLP was applied to the mechanical seal while said seal was in relative movement mode. In this example the SLP was applied to a bottom ash sluice pump by means of a 5 cc syringe; the rate of introduction from the syringe to the seal interface was lower than normal, i.e., the 3 cc aliquot was applied over a period of several minutes instead of during a period of about 5 to about 10 seconds. This slower rate was employed in part because it was observed that the initial application of the SLP to the seal interface effected almost a 100 percent penetration thereof which initially was attributed, or believed to be, because the formulation had been changed to a nonmetal-based cleaner instead of a metal-based cleaner, further testing of this hypothesis resulted in a conclusion that the constituent comprising the cleaner was not the contributing factor, i.e., for all intents and purposes the metal-based cleaner and the nonmetal-based cleaner performed substantially similar as a cleaner in regards to the penetration characteristics of the instant system. It was determined that the substantially reduced foaming action at the seal interface was attributable to the approximately 40 percent increase in the amount of water repellent, i.e., the lemon peel oil, which not only effected the reduced foaming action but also effected improved penetration.

EXAMPLE IX

In the series of tests comprising this example, the formulation utilized in Examples V–VII, supra, and specified in Example V was used except instead of the liquid detergent, Tornado®, other metallic-based cleaner compounds were substituted therefore. These included an industrial solvent marketed by Certified Laboratories of Ft. Worth, Tex., under the name AQUA-SOL; an industrial grade of surface cleaner marketed by Zep Manufacturing Company of Atlanta, Ga., under the name of ZEP FORMULA 158; and a synthetic cleaner marketed by Airex Laboratories of Folcroft, Pa., under the name of Airex RX 44. Said RX 44 contains 2.25 percent of both n-alkyl (60% $C_{14}$, 30% $C_{16}$, 5% $C_{12}$, 5% $C_{18}$) dimethyl benzyl ammonium chlorides and n-alkyl (68% $C_{12}$, 32% $C_{14}$) dimethyl ethylbenzyl ammonium chlorides, 3 percent sodium carbonate, 1 percent tetrasodium ethylenediamine tetra acetate, and 0.4 percent essential oils. In the Zep Formula 158, supra, the apparent active cleaning agent is sodium dodecyl benzene sulfonate and in the case of the AQUA-SOL, supra, the material contains, among other things, sodium metasilicate and ethylene glycol monobutyl ether. The results of the tests comprising this example and Example VIII, supra, indicate that both metal and nonmetal-based cleaners, or detergents, perform substantially equally as constituents of the cleaner of said SLP.

EXAMPLE X

In the tests comprising many of the previous examples wherein the five-constituent formula comprising the instant invention was used, the complexing agent comprised acetic acid which was supplied thereto by the utilization of vinegar, it being understood that glacial acetic acid could be used as the source after proper dilution with aqueous media. In the series of tests comprising this example, the SLP was prepared from the basic pattern of about one part each of complexing agent and water repellent, about two parts each of penetrant and lubricant, and about four parts cleaner, except that phosphoric acid was substituted for the heretofore utilized acetic acid. The concentration of the phosphoric acid so substituted was 85 percent $H_3PO_4$. Upon application of the SLP to a leaking mechanical seal, in this case heater drain pump 16A, the water flow from the seal initially showed no signs of diminishing, however, inspection of the operating seal about one hour later indicated that the seal disruptions had been corrected, i.e., the seal was no longer leaking any discernible amounts of water. In this test the solution, which incidentally comprised a nonmetal cleaner, was injected at the point where the outside diameter of the pump shaft is housed by the inside diameter of the seal gland. This single treatment effected correction of the mechanical seal disruption throughout the period of testing, i.e., about one month.

EXAMPLE XI

In the series of tests comprising this example, a formulation similar to that used in Example X, supra, was used except that the proportion of nonmetallic cleaner was reduced to about 30 percent, and the amount of complexing agent, i.e., phosphoric acid was increased to about 20 percent. As noted above, said percents are by volume unless otherwise indicated. As in the previous example, the initial use of the SLP comprising phosphoric acid instead of acetic acid yielded no immediate discernible results. In fact, after about one hour the seal was still leaking. After a total time of about two hours from the initial application of the SLP another application of the SLP was applied to the disrupted operating seal. In both instances the amount of the SLP applied was approximately 5 cc's. After a total elapsed time of about three hours, the seal disruption was corrected and remained so throughout the test period, i.e., about one month. At first, it was concluded that the phosphoric acid did not work as well as acetic acid; however, it was later discovered that the thrust bearing on this unit was bad and was causing periodic disruptions of the seal. Further tests now have indicated that the use of phosphoric acid yields as good and perhaps better results than acetic acid as the complexing agent.

EXAMPLE XII

The observed results of the previous two examples, i.e., Examples X and XI, supra, initially indicated that although phosphoric acid may be substituted for acetic acid as the complexing agent, it may not under some circumstances work fully equivalent thereto, since it had also been observed that there were test results wherein there was a substantial period of time between application of the SLP to the operating mechanical seal and the obtaining of the results desired. As noted at the end of Example XI, supra, however, this is not really the case. In other such instances, instead of the contribution from a bad thrust bearing, the results may have been dependent on several other factors including the composition of the SLP and instances wherein the seal was "blowing bad," i.e., the disruption is so great that the pressure of the water stream exiting therefrom increased the difficulty for effecting penetration by the SLP of the relative movement interface.

The results of these tests now indicate that almost any mechanical seal possessed with such undesirable disruptions may be effectively cleaned, refaced, and lubricated if it is possible to get the SLP into the sealing area and if the seal faces are not cracked. Accordingly, investigations were initiated for providing a SLP injection area on pumps which have seals that are so physically located and/or designed to prevent or inhibit easy penetration. One resulting embodiment is to provide a SLP injection chamber on the gland seal water line which injection chamber can be properly isolated with attendant valving means which in turn provide for access to and filling of said injection chamber with the requisite amount of SLP when a mechanical seal, which is provided with such an injection chamber embodiment, shows signs of disruptions and ensuing water leakage. Certain provided valving means may then be activated to release the SLP into the seal thereby overcoming the previously inherent penetration problem.

EXAMPLE XIII

In the series of tests comprising this example, it was determined that transportation of the prepared SLP from the point of preparation to the point of application may present some problems when it is necessary to close the container in which the prepared SLP is to be transported. This problem came to light when a request was made from another operating plant site for a quantity of such SLP intended for application to a number of mechanical seals which were disrupted and which would otherwise require being pulled from service. Subsequent to the filling of a metal container with the instant SLP and the securing thereof, the side walls of said container were observed to be bulging outwardly. It was determined that such bulging was due to a buildup of pressure inside the metal container in which the SLP was placed for transportation. The mechanism of such resulting pressure buildup is not understood at the present time and, accordingly, present practice is to transport such SLP in self-venting containers, it being understood, of course, that this is not a problem resulting from encapsulation for transportation over relatively short periods of time.

EXAMPLE XIV

In continuation of developing alternative embodiments as in Example XII, supra, the tests comprising this example were initiated during a 5-day outage of unit 1 at TVA's Cumberland Steam Plant. During such outage the gland seal flush plugs from the mechanical seals on L.A.D.I. supply pumps and on 16A heater drain pumps were removed to effect filling the seal cavity with the SLP solution similar in composition to that in Example V, supra. Since the pumps were out of service for a period of several hours, the SLP was able to soak into the gland seals for a substantial period of time. The results of this test were particularly encouraging for the following reasons: heater drain pump 16A and more particularly the mechanical seal associated therewith ran smoothly and with no evidence of disruptions or leaking for the first several weeks after the pump was put back into service, and as time of observation thereof continues so does the proper operation thereof continue. This result is completely unexpected when it is realized that this is the first time in period of over 9 months that this particular seal did not "blow" when this particular pump was put into service. The L.A.D.I. pump, of course, cycles on and of and previous experience therewith was that when the pump was in the off cycle the associated mechanical seal simply did not "seal off" thereby allowing watet to leak onto the floor. After the treatment, supra, removal of the flush plugs and the soaking of the gland seals, this pump stopped leaking completely.

INVENTION PARAMETERS

After sifting and winnowing through the data supra, as well as other results and operations of my new, novel, and improved technique, including methods and means for the effecting thereof, the operating variables, including the acceptable and preferred conditions for carrying out my invention are summarized below:

| Variables | Limits | Preferred | Most Preferred |
|---|---|---|---|
| **SLP Composition** | | | |
| Cleaner | | | |
| Vol. % in SLP | 20–60 | 30–50 | 40 |
| Soap, detergent, or other cleaning agent or precursors thereof, wt. % liq. | 05–75[a] | " | " |
| Complexing agent | | | |
| Vol. % in SLP | 5–20 | 5–15 | 10 |
| Acetic acid, wt. % | 4–99.8 | 4–8 | 5 |
| Phosphoric acid, wt. % $H_3PO_4$ | 20–115 | 60–105 | 85 |
| Lubricant | | | |
| Vol. % in SLP, silicone oil[b] | 10–30 | 15–25 | 20 |
| Viscosity, (SUS) @ 210° F. | 10–60 | 20–40 | 30 |
| Penetrant | | | |
| Vol. % in SLP | 10–30 | 15–25 | 20 |
| Water repellent | | | |
| Vol. % in SLP, citrus peel or seed oil, lemon or orange peel oil preferred[b] | 05–20 | 05–15 | 10 |
| **Process Conditions** | | | |
| Days between applications of SLP | 01–120 | 01–10 | 07[c] |
| Amount of SLP applied | 02–>20[d] | 02–10 | 03 |

-continued

| SLP Composition | | | |
|---|---|---|---|
| Variables | Limits | Preferred | Most Preferred |
| each treatment, cc | | | |

[a]Concentrations upper limit not critical so long as material is pourable, or can be rendered pourable after dilution with aqueous media.
[b]Commercially available industrial grade pure materials preferred.
[c]Determining factor, such as type and severity of disruptions, will vary from seal to seal rather than from seal type to seal type and, accordingly, the time between applications will generally be dictated on a case-by-case basis.
[d]This is not a critical consideration, i.e., excess amounts are just wasted.

While I have shown and described particular embodiments of my invention, modifications and variations thereof will occur to those skilled in the art. I wish it to be understood therefore that the appended claims are intended to cover such modifications and variations which are within the true spirit and scope of my invention.

What I claim as new and desire to secure by Letters Patent of the United States is:

1. A method for the in situ repair or correction of disruptions occurring on or between seal faces of mechanical seals, said seal faces comprising a stationary face and a rotary face and having, in the operative mode thereof, a relative movement interface therebetween, said disruptions comprising debris ingested between said seal faces, said debris including particulate matter or oil or grease or particulate matter juxtaposed said oil or said grease, or deposits of precipitated salts thereon, or corrosion products formed therewith, or indentations formed thereupon, said indentations including scratches resulting from the abrasive action of said debris or said deposits or said corrosion products or combinations thereof, which method comprises the steps of:

(1) preparing a seal life prolonger (SLP) by mixing:
about 20 to about 60 volume percent cleaner;
about 5 to about 20 volume percent complexing agent;
about 10 to about 30 volume percent lubricant;
about 10 to about 30 volume percent penetrant; and
about 5 to about 20 volume percent water repellent;
said cleaner characterized by its being able to dissolve oil or grease juxtaposed said seal faces or said ingested debris or both, said complexing agent characterized by its being able to remove or dislodge $Ca^{+2}$ cations chemically associated with said precipitated salts, said lubricant comprising a silicone oil characterized as having a relatively low-viscosity of from about 10 to about 60 SUS at 210° F., said penetrant characterized by its being able to provide egress of said SLP to portions of said relative movement interface, and said water repellent being a citrus peel oil or a citrus seed oil, or both; and (2) applying to a region of said mechanical seal, including at least a portion of the periphery of said relative movement interface a quantity of said (SLP) while said mechanical seal is in operative mode.

2. The method of claim 1 wherein said application is repetitively performed at frequent periodic intervals.

3. The method of claim 2 wherein said periodic intervals range from about 1 day to about 3 months.

4. The method of claim 2 wherein said periodic intervals range from about 1 day to about 30 days.

5. The method of claim 2 wherein said periodic intervals range from about 1 day to about 10 days.

6. The method of claim 2 wherein said periodic intervals range from about 1 day to about 3 days.

7. The method of claim 1 wherein said cleaner comprises from about 30 to about 50 percent of said SLP, wherein said lubricant and said penetrant each comprise from about 15 to about 25 percent of said SLP, and wherein said complexing agent and said water repellent each comprise from about 5 to about 15 percent of said SLP, said percentages being on a volume basis.

8. The method of claim 7 wherein said cleaner comprises about 40 percent of said SLP, wherein said lubricant and said penetrant each comprise about 20 percent of said SLP, and wherein said complexing agent and said water repellent each comprise about 10 percent of said SLP, said percentages being on a volume basis.

9. The method of claim 1 wherein said cleaner comprises an aqueous solution containing from about 5 percent to about 75 percent by weight of a soap or a detergent or mixtures thereof, wherein said complexing agent is selected from the group consisting of phosphoric acid, acetic acid, and mixtures thereof; said acetic acid having a concentration ranging from about 4 percent to about 99.8 percent by weight, and said phosphoric acid being of a concentration ranging from about 14 percent to about 83 percent by weight $P_2O_5$, and wherein said penetrant comprises napththenic distillates in admixture with volatile carriers, said volatile carriers ranging from about 20 to about 80 percent of said admixture by volume.

10. The method of claim 9 wherein said complexing agent is selected from the group consisting of phosphoric acid, acetic acid, and mixtures thereof; said acetic acid being of a concentration ranging from about 4 percent to about 8 percent by weight, and said phosphoric acid being of a concentration ranging from about 43 percent to about 76 percent by weight $P_2O_5$, and wherein said penetrant is chemically neutralized to a pH ranging from about 6 to about 8.

11. The method of claim 9 wherein said complexing agent is selected from the group consisting of phosphoric acid, acetic acid, and mixtures thereof; said acetic acid being of a concentration of about 5 percent by weight, and said phosphoric acid being of a concentration of about 62 percent by weight $P_2O_5$.

* * * * *